US006289987B1

(12) United States Patent
Lay, Jr.

(10) Patent No.: US 6,289,987 B1
(45) Date of Patent: Sep. 18, 2001

(54) INTEGRAL BLADE DOWNHOLE WASH TOOL

(76) Inventor: Milford Lay, Jr., P.O. Box 1537, Mongan City, LA (US) 70381

( * ) Notice: Subject to any disclaimer, the term of this patent is extended or adjusted under 35 U.S.C. 154(b) by 0 days.

(21) Appl. No.: 09/518,514

(22) Filed: Mar. 3, 2000

(51) Int. Cl.[7] ..... E21B 27/00

(52) U.S. Cl. ..... 166/169; 166/175; 166/223; 166/334.4

(58) Field of Search ..... 166/169, 170, 166/175, 223, 332.4, 334.1, 334.2, 334.4, 222, 311, 312, 373, 374

(56) References Cited

U.S. PATENT DOCUMENTS 3,720,264 * 3/1973 Hutchison .
3,811,499 * 5/1974 Hutchison .
3,850,241 * 11/1974 Hutchison .
4,088,191 * 5/1978 Hutchison .
5,033,545 * 7/1991 Sudol .
5,327,974 * 7/1994 Donovan et al. .
5,735,359 * 4/1998 Lee et al. .
5,839,511 11/1998 Williams .

* cited by examiner

*Primary Examiner*—Roger Schoeppel
(74) *Attorney, Agent, or Firm*—Jesse D. Lambert

(57) ABSTRACT

Apparatus for efficient cleaning of downhole equipment in boreholes, especially oil and gas wells drilled offshore from floating drilling vessels. The apparatus is a wash tool having an elongated central body with a longitudinal bore therethrough. A plurality of integral, outwardly-extending blades radiate outward from the central body. Wash ports extend radially from the longitudinal bore through the body of the blades, to the outermost surface of the blades and exiting at that point. Spiral or straight blades may be employed. A reduced diameter, extended nose portion is attached to the lower end of the tool. Removable jet nozzles may be installed in the wash ports near the outermost blade faces, to create a high velocity wash stream.

8 Claims, 3 Drawing Sheets

INTEGRAL BLADE DOWNHOLE WASH TOOL

BACKGROUND—FIELD OF THE INVENTION

This invention relates generally to downhole tools used in the oil and gas industry. With further specificity, this invention relates to an improved design of tool adapted to be run downhole in a wellbore being drilled, especially a wellbore drilled from a floating vessel, to permit the pumping of fluids (typically drilling muds) through the tool directed toward the sides of the wellbore and downhole equipment such as a wellhead or blowout preventer assembly, to effect cleaning of the equipment surfaces.

BACKGROUND—RELATED ART

Although earthen boreholes may be drilled for a variety of reasons, in particular many are drilled for oil and gas exploration and production. Typically, drilling fluid or "mud" is pumped downhole through the drillstring, through the drill bit and back to surface, to remove "cuttings" (which are the pieces of earth removed in the drilling process) and perform other functions such as downhole pressure control, cooling of the drill bit, etc. Depending upon the formations being drilled, the cuttings may be very sticky, as in the gumbo mud regions of the Gulf Coast, and often tend to stick onto and accumulate on the inner surfaces of downhole equipment, including the casing strings, wellheads, blowout preventers, and the like.

Increasingly, wells are being drilled offshore in water depths requiring floating drilling rigs, either semi-submersibles or drill ships. With a floating drilling vessel, a large diameter "riser" connects the drilling rig to a subsea blowout preventer stack, and thereby to a subsea wellhead, which rests on the ocean floor. The subsea wellhead has an inner profile to accommodate casing "hangers" or spools attached to the upper ends of casing strings, and which seat in the subsea wellhead or in the profiles of previously-run hangers of the larger casing strings. It will be readily understood that it is necessary to have a clean seating profile, that is, free of adhered drill cuttings, gumbo mud and the like, in order to present a seating profile which will accept a later-run casing hanger, and ensure proper seating, pressure sealing, etc. In addition, blowout preventers must be periodically pressure tested to satisfy safety tests and regulatory requirements. To pressure test blowout preventers, a test plug must be seated in the subsea wellhead to provide a seal against which to pressure up and verify that blowout preventer rams and annular preventers are properly functioning.

It is therefore desirable to have a means by which downhole equipment, including but not limited to subsea blowout preventer stacks and subsea wellheads, may be cleaned of adhering drill cuttings and the like.

Prior art apparatus and methods have included the use of downhole brushes, manipulated across from the area to be cleaned, to mechanically dislodge any adhering cuttings, etc. Other prior art methods have employed the use of tools generating a stream of drilling fluid pumped under high rates and/or pressures, and directed toward the sides of the wellbore or downhole equipment. The fluid impinges upon the surface, dislodges any accumulated material, and thereby cleans the downhole surface. It will be appreciated, then, that delivering the fluid with maximum velocity, and consequently force, against the surface to be cleaned, is of key importance. Further, as wash tools are employed downhole at times and are at times subject to rough treatment, it is further desired that the tool be of rugged construction. Further still, wash tools should be adapted to closely match the profile of the wellbore surfaces being cleaned, once again to permit at least some mechanical cleaning of the surface, centralize the tool in the wellbore, and the like.

Such prior art downhole wash tools have been of various simple designs, such as merely a partial joint of tubing or drill pipe blanked or closed off at its lower end and having a number of holes drilled in the wall of the pipe, so that drilling fluids pumped therethrough must exit the tubing or drill pipe, and be directed toward inner surfaces of downhole equipment. Such tools lack effectiveness for a number of reasons: the tool is poorly centered in the wellbore; the wash stream of fluid is not properly focused; and the outlet of the wash port is (relatively speaking) a significant distance from the surface to be cleaned, so that much velocity and consequently energy is lost. Another design of wash tool is shown in U.S. Pat. No. 5,839,511 to Williams, which has outwardly extending (apparently non-integral) blades and offset (not concentric with the blades) wash jets, and further combined (in at least one embodiment) with brushes.

However, the known prior art does not disclose a downhole wash tool of unitary construction, having integral outwardly extending blades, with wash ports extending from a central, longitudinal bore of the tool through the blades to their outermost faces, thereby placing the port outlets close to the surface of the equipment being cleaned, and delivering the fluid with great force. Further, the known prior art does not disclose such a downhole wash tool having an outer profile closely matching the inner profile of the equipment into which it will be run.

DESCRIPTION OF THE PREFERRED EMBODIMENT

Figure 1:
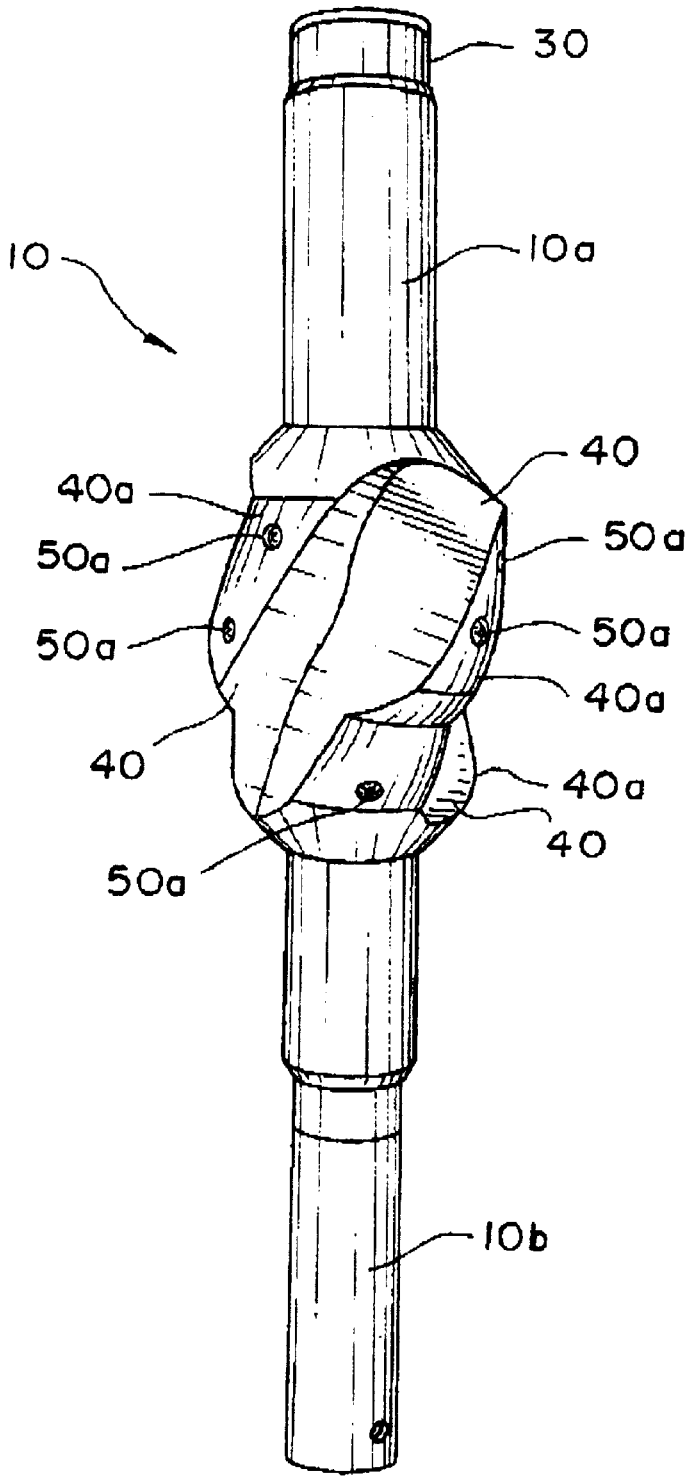
FIG. 1 is an isometric schematic of the integral blade downhole wash tool of the present invention.
Figure 2:
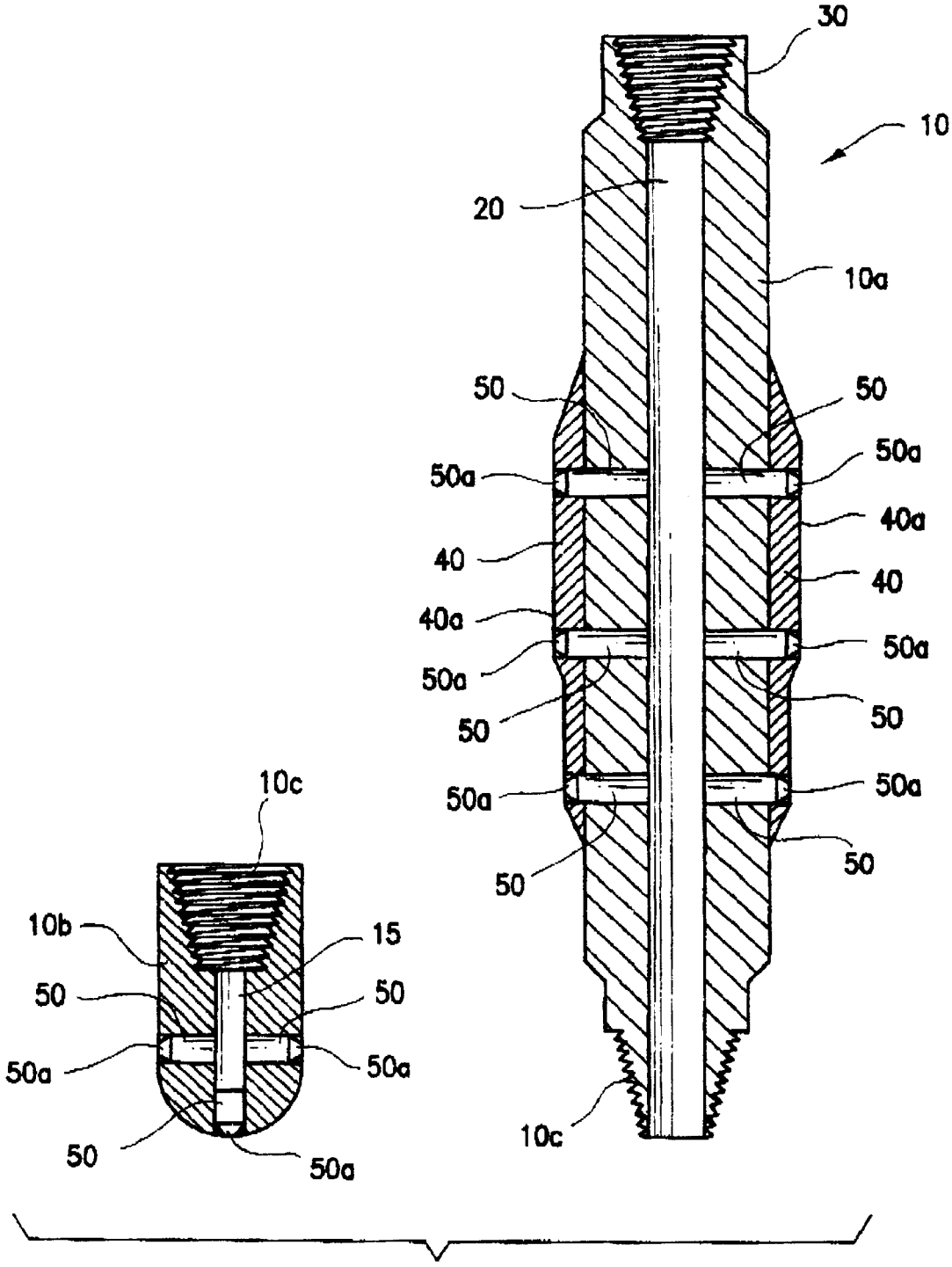
FIG. 2 is a schematic in cross section of the present invention.

Although many different embodiments of the present invention are possible, with reference to the drawings a presently preferred embodiment will be described. Referring to FIGS. 1 and 2, the wash tool 10 generally comprises an elongated central body 10*a* having a longitudinal bore 20 therethrough. An upper end 30 is adapted for connection to a drill string for lowering wash tool 10 to a desired location in a wellbore. Generally, a threaded connection is so provided, although it is understood that other types of connections well known in the art could be used.

Wash tool 10 comprises a plurality of integral, outwardly extending blades 40 radiating from central body 10*a*. In a presently preferred embodiment, wash tool 10 comprises three of blades 40, and blades 40 spiral at least a portion of the way around the circumference of central body 10*a*, as best seen in FIG. 1. While the dimensions of blades 40 may be varied, the outer maximum diameter formed by blades 40 is preferably relatively close to the inner diameter of the downhole equipment into which the tool is to be run. It is understood that different numbers of blades may be used, including blades in a "straight" (that is, generally parallel to the bore of wash tool 10) and spiral configuration.

A plurality of wash ports 50 for fluid flow extend from bore 20, through the radius of blades 40 and to the outer face 40*a* of blades 40. Although various numbers of wash ports could be employed, in the preferred embodiment each of blades 40 comprises at least one of said wash ports 50, and preferably at least three wash ports spaced along the longitude of each of blades 40. Removable jet nozzles 50*a* may be disposed in wash ports 50 proximal outer face 40*a*, to reduce flow diameter of wash port 50 and thereby increase the velocity of drilling fluid exiting the tool. In the preferred embodiment, blades 40 have upper and lower sections and form two, stepped-down diameters, with the smaller diameter proximal the lower end of the tool, as seen in FIGS. 1 and 2. This stepped-down diameter configuration permits closer adaptation to the inner diameters of particular configurations of downhole surfaces.

Wash tool 10, in the preferred embodiment, may further comprise a reduced diameter, forward nose section 10*b*. Nose section 10*b* may be removable, and attached to wash tool 10 via a threaded connection 10*c*, as shown in FIG. 2. Nose section 10*b* also has a longitudinal bore 15 extending at least partially through nose section 10*b*, and terminating without fully penetrating same, leaving a "blanking" section at the lowermost end of nose section 10*b*. Nose section 10*b* further comprises one or more wash ports, also designated by 50; one or more of said ports 50 may extend through the side wall of nose section 10*b*, while yet another of said wash ports 50 may be centrally located; that is, extend from the terminus of bore 15 to the end of nose section 10*b*.

Wash tool 10 may be made by machining, that is, milling out the desired central body 10*a* and blade 40 configuration, from a sufficiently large body of metal; or by other methods such as castings, forgings, or other methods well known in the art, to produce the unitary construction of the present invention. Different metals and metal alloys may be employed to manufacture wash tool 10. The exact dimensions and configurations may be as suitable to adapt to particular configurations of downhole equipment.

Figure 3:
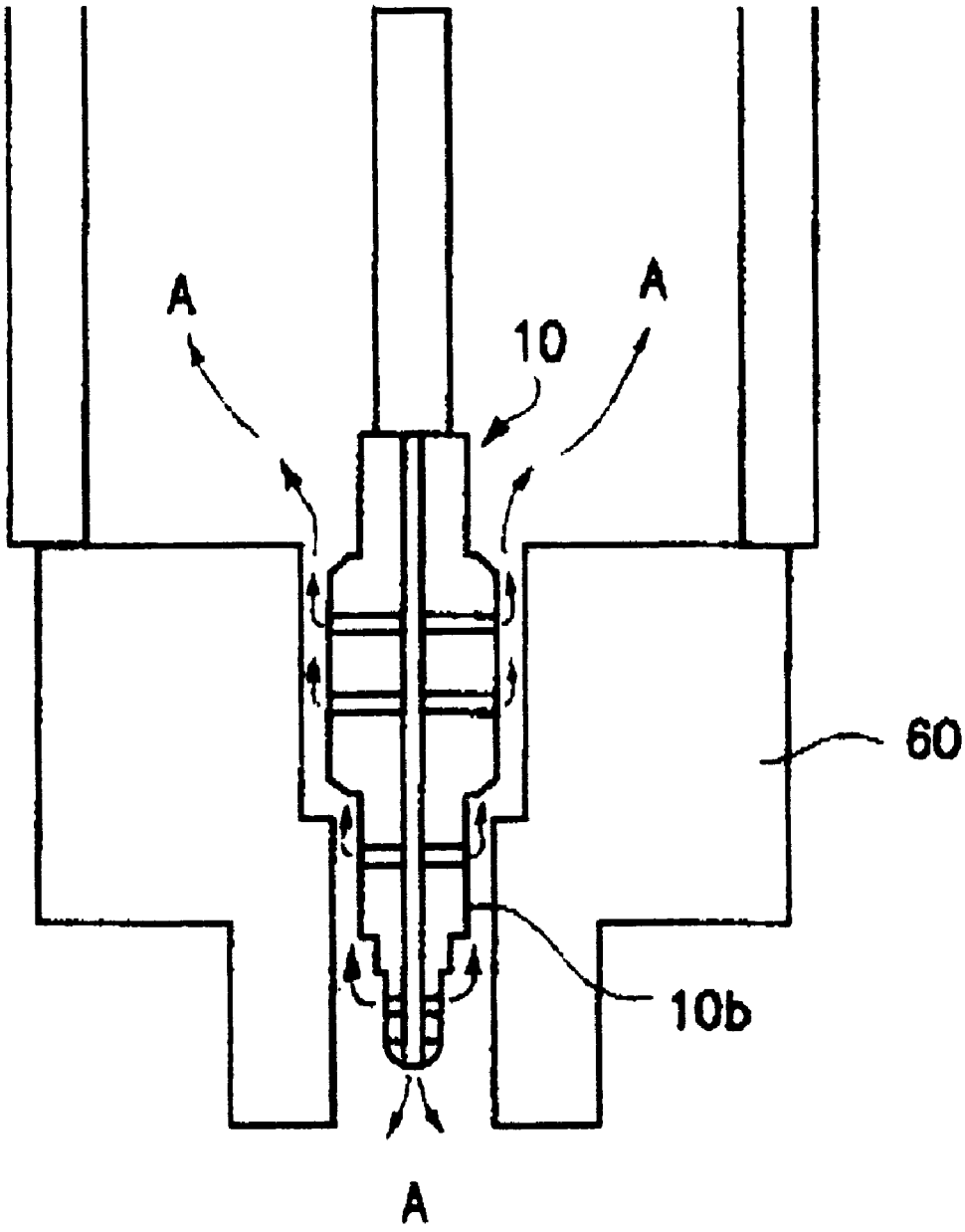
FIG. 3 is a schematic in partial cross section, of the downhole wash tool of the present invention positioned in downhole equipment for washing thereof.

In use, wash tool 10 is attached to the end of a tubular string, typically a drill string, and lowered downhole to the downhole equipment being cleaned, such as a subsea wellhead or blowout preventer stack. As an example, with reference to FIG. 3, wash tool 10 may be positioned within the downhole equipment, for example subsea wellhead designated as 60, so that the reduced diameter portion of blades 40 and nose portion 10*b* extends down into a reduced diameter section of subsea wellhead 60, while blades 40 are opposite an upper, larger diameter section of subsea wellhead 60. Once wash tool 10 is in position, drilling fluid is pumped down through the drillstring, through bore 20 and 15 of wash tool 10, and ultimately out wash ports 50. Drilling fluid is thereby directed at high velocity onto the surfaces to be cleaned, as indicated by the directional arrows A, and it will be appreciated that the design of the present invention whereby wash ports terminate relatively close to the surface to be cleaned, results in optimum cleaning effect. In addition to fluid pumping, wash tool 10 may be raised and lowered across a section to be cleaned, and rotated as well, all by manipulation of the drillstring to which wash tool 10 is attached.

While the foregoing description contains many specificities, it is to be understood that same are provided in order to fully describe the presently preferred embodiments of the invention. Other embodiments are possible as well, such as different shapes, sizes, and configurations of the blades, the central body, and the nose portion. Different numbers and sizes of wash ports could be included. Various means of attachment to a drillstring are possible. Different metals and methods of construction known in the art could be used.

Therefore, the scope of the present invention is to be measured not by the specific examples given, but by the scope of the appended claims and their legal equivalents.

I claim:

1. An apparatus for hydraulic cleaning of downhole surfaces in a wellbore, comprising:

a) an elongated central body with a longitudinal bore therethrough, said central body comprising a plurality of integral, outwardly extending blades, and a plurality of fluid flow ports disposed in said blades, each of said fluid flow ports extending from said bore to an outer edge of said blades, an upper end of said elongated central body being adapted for removable connection to a tubular string; and b) said central body further comprising an elongated, reduced diameter nose section attached to a lower end of said central body.

2. The apparatus of claim 1, wherein each of said blades has an upper and a lower section, an outer diameter of said lower section being less than an outer diameter of said upper section, and said outer diameters have dimensions adapted to closely engage downhole equipment surfaces.

3. The apparatus of claim 2, wherein said reduced diameter nose section comprises a plurality of holes extending from said bore to an outer surface.

4. The apparatus of claim 1, further comprising removable nozzles disposed in said fluid flow ports.

5. The apparatus of claim 1, wherein said blades are of a spiral configuration.

6. The apparatus of claim 1, wherein said apparatus comprises a threaded connection at its upper end.

7. An integral blade downhole wash tool for hydraulic cleaning of subsurface borehole surfaces, comprising:

a) an elongated central body with a longitudinal bore therethrough, said central body comprising a plurality of integral, outwardly extending blades, and a plurality of fluid flow ports disposed in said blades, each of said fluid flow ports extending from said bore to an outer edge of said blades, an upper end of said elongated central body having a threaded connection for removable connection to a tubular string, said plurality of integral blades comprising an upper, larger diameter section and a lower, smaller diameter section, each of said diameters dimensioned for close engagement with downhole equipment;

b) removable flow nozzles disposed in each of said fluid flow ports; and c) an elongated, reduced diameter nose section removably attached to a lower end of said central body, said nose section having a longitudinal bore and a plurality of fluid flow ports extending from said longitudinal bore through a wall of said nose section.

8. The wash tool of claim 7, wherein said central body and said blades are integrally formed by machining said central body and said blades from an appropriately sized body of metal.

* * * * *